US005813188A

United States Patent [19]

Behlen

[11] Patent Number: 5,813,188

[45] Date of Patent: Sep. 29, 1998

[54] ACCESSORY FOR BUILDING CONSTRUCTION

[75] Inventor: Dean B. Behlen, Paso Robles, Calif.

[73] Assignee: Diane E. Miller, Templeton, Calif.

[21] Appl. No.: 896,414

[22] Filed: Jul. 18, 1997

[51] Int. Cl.[6] ..... F04B 1/38

[52] U.S. Cl. ..... 52/699; 52/700; 249/91; 249/93

[58] Field of Search ..... 52/431, 699, 700; 249/30, 91, 93

[56] References Cited

U.S. PATENT DOCUMENTS

| | | | |
|---|---|---|---|
| D. 312,382 | 11/1990 | Ryll | D8/349 |
| 3,150,429 | 9/1964 | Shaffer | 25/118 |
| 3,552,734 | 1/1971 | Severino | 269/287 |
| 3,960,356 | 6/1976 | Adams | 249/93 X |
| 4,736,554 | 4/1988 | Tyler | 52/700 X |
| 4,872,298 | 10/1989 | Klemic, Jr. | 52/699 X |
| 5,060,436 | 10/1991 | Delgado, Jr. | 52/295 |
| 5,240,224 | 8/1993 | Adams | 249/93 |
| 5,337,534 | 8/1994 | Nasca | 52/745.21 |
| 5,609,005 | 3/1997 | Schierloh et al. | 249/91 X |
| 5,635,097 | 6/1997 | Aiello | 249/93 X |
| 5,670,076 | 9/1997 | Leek | 52/700 X |
| 5,688,428 | 11/1997 | Maguire | 249/91 |

*Primary Examiner*—Lanna Mai
*Attorney, Agent, or Firm*—Leo F. Costello

[57] ABSTRACT

A holder for use in building construction for holding anchor bolts, rebar, in-concrete plumbing, and the like, in predetermined positions during the pouring of concrete therearound. The holder is molded in one piece from a suitable plastic and includes an elongated base plate, the front end of which has an end hole therethrough; a sleeve upstanding from the base plate over the end hole; elongated first and second side ribs upstanding from the top surface of the base plate along the side edges thereof and connected to the sleeve; an end rib partially wrapped around the sleeve and connected to the side ribs; a center rib upstanding from the base plate between the side ribs and also connected to the sleeve; webs upstanding from the base plate, interconnecting the side and center ribs, and having nail holes therethrough. The holder preferably also has an end plate. The integration of the ribs and webs with each other and with the base plate, the sleeve, and the end plate, in one-piece, and out of plastic, provides a lightweight, durable, low cost holder for the purposes described. A feature of the invention is the molding of the holder out of colored plastic so that it can be readily seen by construction workers after the concrete has been poured partially covering it. An alternative embodiment provides such a holder that can be spread apart for receiving and clamping around anchor bolts, rebar or similar construction elements.

22 Claims, 4 Drawing Sheets

ACCESSORY FOR BUILDING CONSTRUCTION

BACKGROUND

Anchor bolts are well known elements used in the foundation of a house and other buildings. These bolts perform a very important function in that they attach the wood frame of the house to the foundation wall. If the anchor bolts themselves are not properly positioned and securely attached to the foundation, they fail to perform their function, and the house may come off the foundation, especially in an earthquake.

According to preferred building standards and perhaps by local code, these bolts should be located at a maximum number of inches on center and in the center of the wall plate or mud sill. However, since anchor bolts are conventionally immersed in the wet concrete of the foundation wall after it is poured but before it hardens, they are often not correctly positioned and may be damaged by the concrete. Thus, they may be incorrectly spaced, off center, out of vertical, and/or their threads covered with concrete. Moreover, an anchor bolt is usually J-shaped or S-shaped at its lower end so that it can be hooked around the reinforcing rebar in the concrete, but insuring such a connection is difficult after the concrete is poured.

Apart from properly positioning the anchor bolts, other important features of an anchor bolt holder include durability, cost and reusability. Devices have been proposed for holding anchor bolts in proper position, but the known devices do not have all the desirable features. For example, the anchor bolt holder in Design Pat. No. Des 312,382 incorporates a sleeve or tower for receiving the head of an anchor bolt and protecting its threads, but this sleeve is subject to breakage where it connects to the base plate so its durability and reusability are compromised. The anchor bolt holder in the Adams U.S. Pat. No. 5,240,224 does not protect the threads of the anchor bolts, is unnecessarily complex, and is thus relatively more expensive. Moreover, although Adams holder can be opened to fit around an anchor bolt, the latter is not clamped in the device but must be held there by a separate clip.

SUMMARY

An accessory for use in building construction to hold anchor bolts, rebar, in-concrete plumbing, and the like elements, is provided. The holder is used to hold such elements in predetermined positions during the pouring of concrete therearound. It is molded in one piece from a suitable plastic and includes an elongated base plate having front and rear ends, opposite side edges, a top surface, and a flat bottom surface. The front end of the base plate has a hole extending therethrough from the top surface to the bottom surface. The holder also has a sleeve or tower; side, center and end ribs; and a plurality of webs, all integral with and upstanding from the top surface of the base plate. The sleeve is concentric with and fits over the hole in the end of the base plate, whereas the ribs and flanges serve to strengthen both base plate and particularly the sleeve. Thus, the side ribs extend from the rear end of the base plate along the side edges thereof to the sleeve and are integrally connected to the sleeve. The end rib integrally wraps partially around the sleeve and integrally joins the side ribs on opposite sides thereof. The center rib also extends from the rear end of the base plate between the side ribs and is integrally connected to the sleeve. The webs extend transversely of the base plate, in offset relation to each other and are individually integrally connected to the side and center ribs. The webs and underlying portions of the base plate also have nail holes therethrough. The integration of base plate, the sleeve and the ribs and webs in one-piece and out of plastic provides a lightweight, durable, low cost holder for the purposes described. The holder preferably also has an end plate projecting downwardly from the base plate at its rear end. A feature of the invention is the molding of the holder out of colored plastic so that it can be more easily seen after the concrete has been poured, thereby partially covering it. An alternative embodiment provides such a holder that can be spread apart for receiving, and then closing and clamping around, anchor bolts, rebar, in-concrete pipe, and similar construction elements.

An object of this invention is to position anchor bolts in their proper positions prior to pouring concrete around them and to hold them in such positions while the concrete is being poured.

Another object is to provide an anchor bolt holder that can be removed from the hardened concrete and anchor bolt embedded therein without breaking or deformation so that the holder can be reused.

An additional object is to protect the threads of an anchor bolt while holding the same in proper position within a form while concrete is being poured around the anchor bolt.

A further object is to provide an anchor bolt holder molded in one piece so as to avoid the complexity of multiple parts.

Still another object is to provide an inexpensive anchor bolt holder.

Yet another object is to provide an anchor bolt holder that is adjustable for holding anchor bolts within forms of various sizes.

A more specific object is to reinforce the sleeve or tower of an anchor bolt holder that receives the anchor bolt so as to maintain the anchor bolt in a desired attitude while pouring concrete and so as to prevent breakage of the sleeve when the holder is removed from the poured concrete.

Another specific object is to reinforce the base plate of an anchor bolt holder where nails are driven in order to maintain the integrity of the base plate and sleeve.

Yet another object is to provide an anchor bolt holder that can be spread apart, placed around an anchor bolt, and then clamped around the bolt to hold it proper position within concrete forms.

An additional object is to obviate the need for using a nut to hold an anchor bolt in position while concrete is being poured.

A still further object is to provide a clamping-type anchor bolt holder that is inexpensive, uncomplicated, durable and reusable.

An additional object is to provide an anchor bolt holder that is easier to see after being partially covered with concrete.

These and other objects, features, and advantages of the present invention will become apparent upon reference to the following description, accompanying drawings, and appended claims.

DETAILED DESCRIPTION

Figure 1:
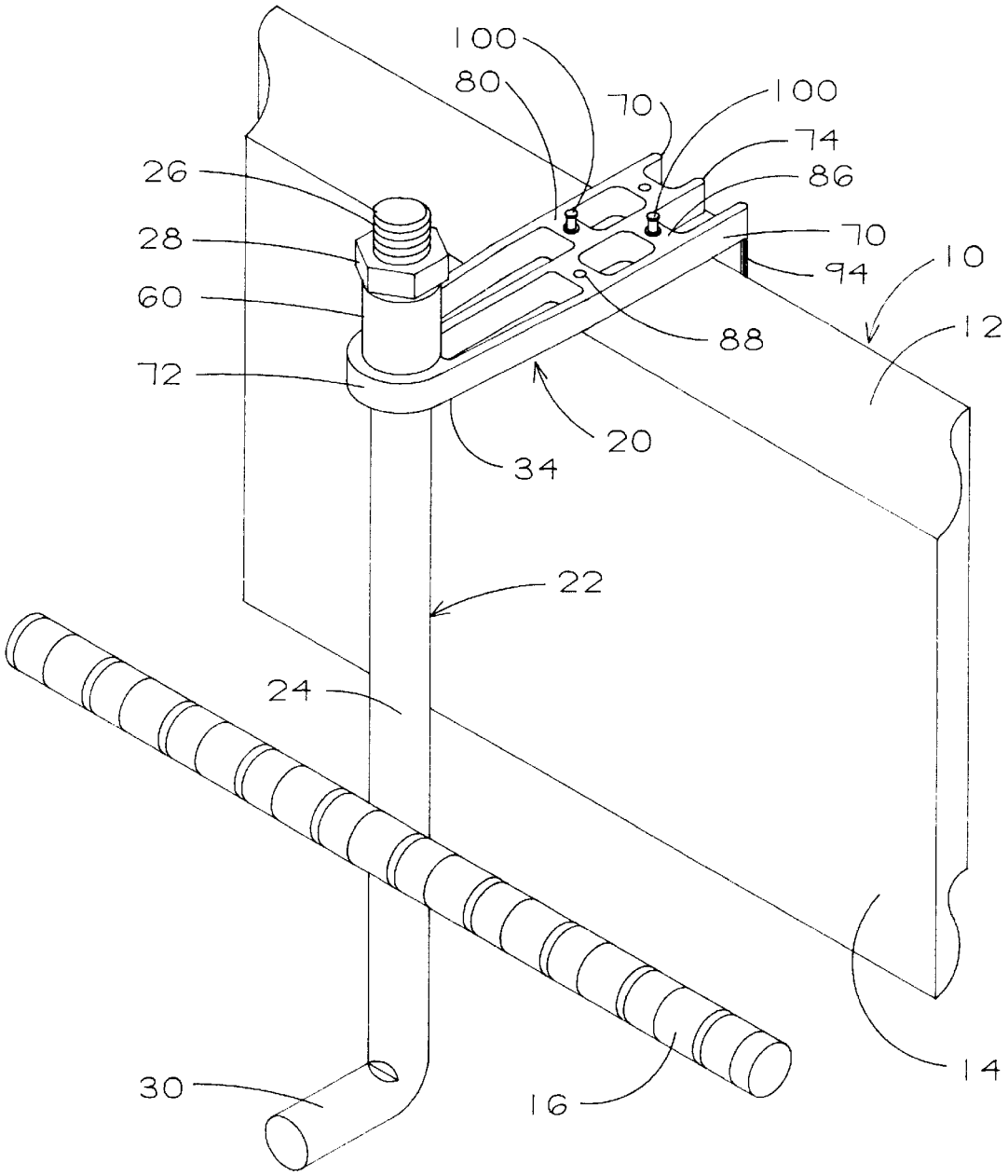
FIG. 1 is a fragmentary isometric view of one of the forms, a segment of rebar, and an anchor bolt all of which are used in pouring a concrete foundation wall but particularly showing an anchor bolt holder incorporating the principles of the present invention supporting the anchor bolt in desired position within the form.

With reference to FIG. 1, a portion of a form 10 used in the pouring of a concrete foundation or a wall, for example, is shown and indicated by the reference numeral 10. This form has a flat top surface or edge 12 and an inside surface 14. Also shown in FIG. 1 is a segment of rebar 16 that is usually positioned within the form prior to the pouring of concrete and for the purpose of reinforcing the foundation, slab, or other concrete structure.

An anchor bolt holder 20 incorporating the principles of the present invention is illustrated in FIG. 1 and is shown supporting an anchor bolt 22 within the form 10. The anchor bolt has an elongated shank 24 and an upper threaded end 26 on which is placed a nut 28, and a lower end 30 that is either J-shaped, as shown, or S-shaped, not shown.

Figure 2:
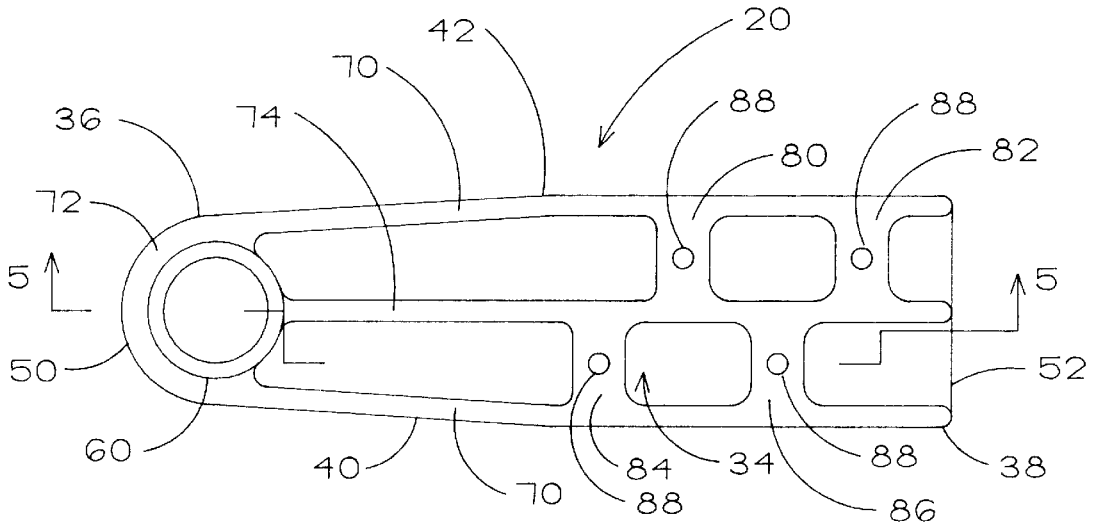
FIG. 2 is an enlarged top plan view of the anchor bolt holder shown in FIG. 1 but separated from the form and anchor bolt.
Figure 3:
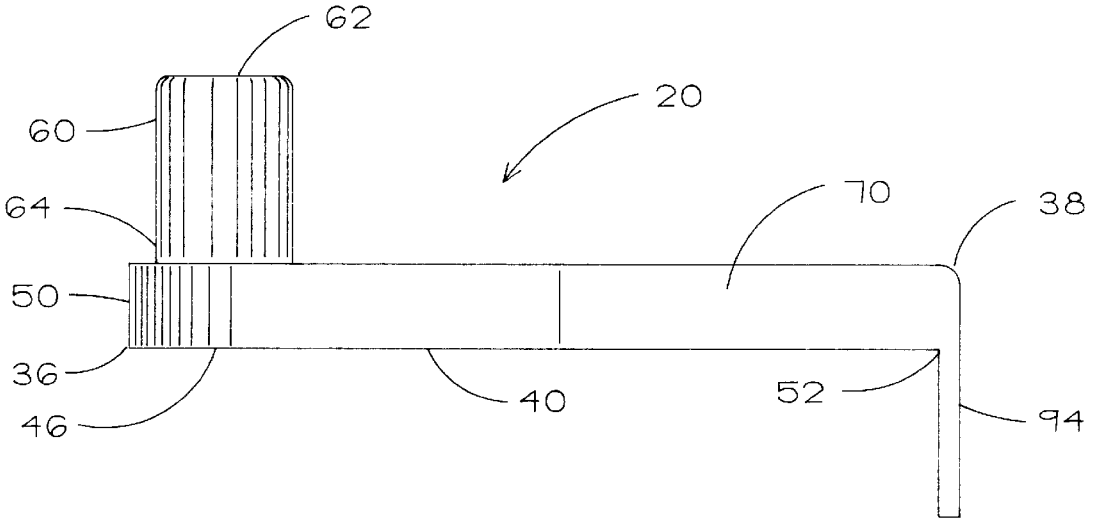
FIG. 3 is side elevation of the anchor bolt holder shown in FIG. 2.
Figure 4:
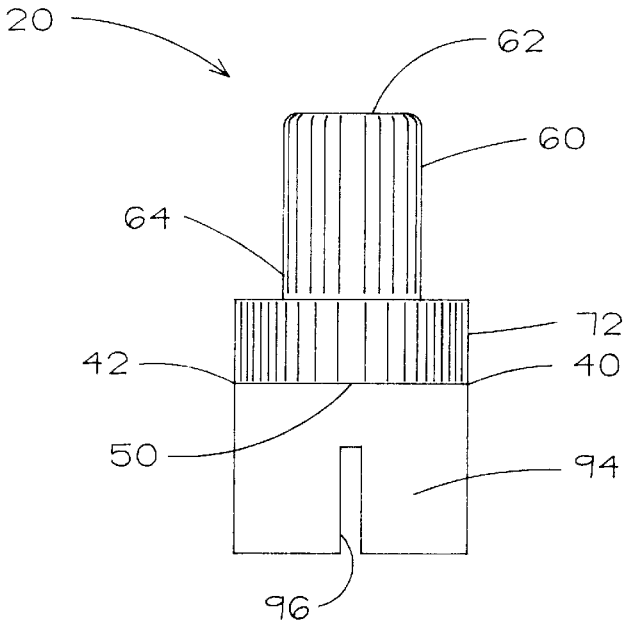
FIG. 4 is a front end view of the anchor bolt holder shown in FIG. 2.
Figure 5:
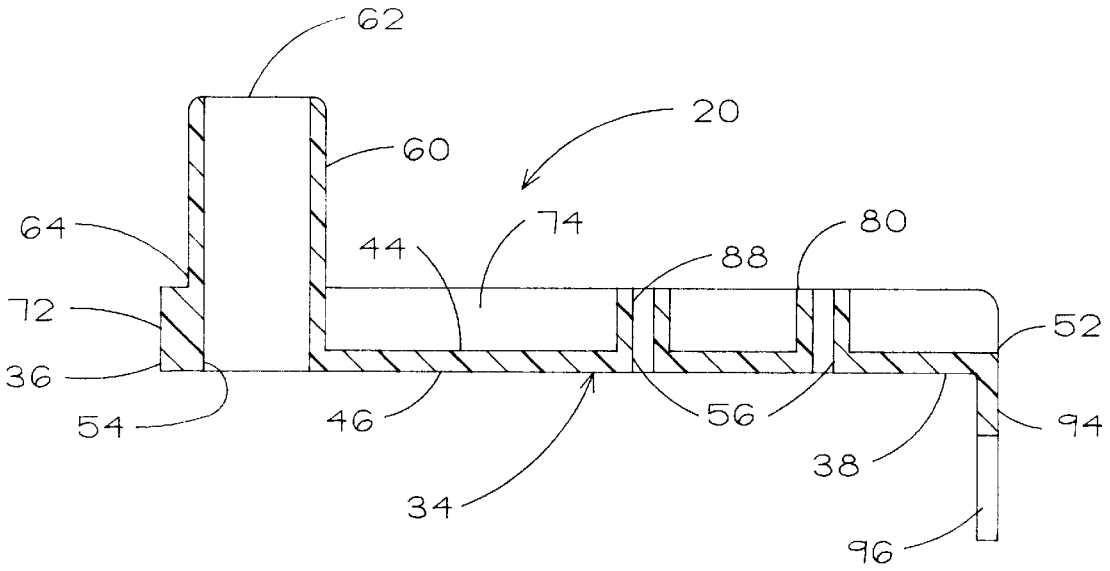
FIG. 5 is a longitudinal section taken along line 5—5 in FIG. 2.

The anchor bolt holder 20 (FIGS. 2 through 5) includes an elongated base plate 34 having front and rear ends 36 and 38, side edges 40 and 42, a top surface 44, and a flat bottom surface 46. The front end terminates in an arcuate end edge 50, and the rear end terminates in a straight end edge 52. As best shown in FIGS. 2 and 3, the side edges extend forwardly from the rear edge in parallel relation to each other about half the length of the base plate and then converge slightly toward the front arcuate end edge. The front end of the plate has a circular end hole 54 extending therethrough from the top surface to the bottom surface. The base plate also has a plurality of nail holes 56 along each side and extending through the plate.

A tubular sleeve 60 is integral with and in upstanding relation from the top surface 44 of the base plate 34 in perpendicular relation thereto and at the front end 36 of the base plate. The sleeve has a lower end or base 64 that is over and in concentric relation with the end hole 54 and preferably tapers slightly upwardly in its outside diameter to an upper edge 62. The sleeve and end hole have the same internal diameter which is uniform throughout for receiving the shank 24 of the anchor bolt 22. The diameter of the upper edge of the sleeve is less than the diameter of the nut 28 so that when the shank of the anchor bolt is within the sleeve and the nut is on the threaded end of the anchor bolt, the anchor bolt is supported in the sleeve by the nut resting on the upper edge, as shown in FIG. 1.

The base plate 34 (FIGS. 2 through 5) also includes a pair of elongated side ribs or flanges 70 which are integral with and in upstanding relation from the top surface 44 of the base plate 34 along the side edges 40 and 42 and so that each rib is flush with its respective side edge. Also, the anchor bolt holder 20 has an arcuate end rib or flange 72 integral with upstanding from the top surface 44 of the base plate along the arcuate end edge 50 so that the end rib is flush with the end edge and so that the end rib partially surrounds and is integral with the base 64 of the sleeve 60.

An important feature is that the end rib 72 integrally joins the sleeve 60 and the forward ends of the side ribs 70 where they meet the sleeve, thereby providing significant reinforcement for the sleeve. The holder 20 has an elongated central rib 74 integral with and upstanding from the top surface 44 of the base plate 34 equidistant from and between the side ribs 70. Also of special importance is that this central rib extends lengthwise of the base plate from the rear end edge 52 to the sleeve and is integral with the sleeve, thereby adding to the reinforcement of the sleeve as well as the base plate.

A plurality of webs 80, 82, 84, and 86 are integral with and extend between each side rib 70 and the central rib 74 on each side of the base plate 34. The webs 80 and 82 on one side of the base plate are spaced lengthwise of each other and offset from the webs 84 and 86 which are likewise spaced lengthwise of the base plate from each other on the other side of the base plate. Each web has a nail hole 88 therein which extends through the web and is aligned with a nail hole 56 in the base plate. These nail holes are parallel with the axis of the sleeve 60. It is to be understood that the invention is not limited to the number of webs and nail holes shown. In alternative embodiments, additional webs and associated nail holes may be provided between the webs 80 and 84 and the sleeve, even right up to the sleeve or tower.

The anchor bolt holder 20 (FIGS. 2 through 5) also includes a rectangular rear plate 94 which is integral with the base plate 34 and projects downwardly from the rear end edge 52 in perpendicular relation to the base plate. The rear plate has a nail slot 96 therein which opens at the lower edge of the rear plate.

Although the invention is not limited to particular dimensions, it will be helpful in understanding the invention to set forth the dimensions of the disclosed embodiment as illustrated in FIGS. 2 through 5. It is first to be understood that a ⅝ inch holder is shown in full scale in FIGS. 2 through 5. By a ⅝ inch holder is meant that the inside diameter of the sleeve 60 and the inside diameter of the front end hole 54, both of which are the same, is ⅝ inch. The holder is made with different inside diameters of the sleeve, such as ½ inch, ⅝ inch, ¾ inch and ⅞ inch, for use with different sizes of anchor bolts and is colored-coded for these various sizes.

Thus, the illustrated embodiment of the holder 20 in FIGS. 1–5 has the following dimensions: length of the base plate 34 equal to four and three-quarter inches; width at the rear edge 52 equal to one and three-eighths inch; outside diameter of the upper edge 62 of the sleeve 60 equal to three-quarter inch; inside diameter of sleeve equal to five-eighths inch (although this dimension will vary as noted above); height of the sleeve equal to one inch; thickness of the base plate equal to ⅛ inch; height of the ribs 70, 72, 74 and webs 80–86 off the base plate equal to ⅜ inch; thickness of the ribs equal to ⅛ inch; thickness of the webs equal to 5/16 inch; length of the rear plate 94 from the rear edge 52 to the lower edge of the rear plate equal to one inch; longitudinal spacing between nail holes 88 on each side of the base plate equal to one and one-sixteenth inch; and the angular embrace or wrap-around of the sleeve by the end rib equal to about eighty degrees.

The anchor bolt holder 20 (FIGS. 1–5) is preferably molded in one piece from a high impact, light weight plastic, such as a styrene plastic. Moreover, the plastic used is preferably colored with a bright color, such as shocking pink, light blue, bright green, or yellow. As such, the anchor bolt holders are easy to see and identify by construction workers when the holders are supporting anchor bolts 22 and after concrete has been poured within the forms 10 embedding the anchor bolts and often partially obscuring the anchor bolt holders. As stated above, coloring is also employed to distinguish among the various sizes of holders.

In use (FIG. 1), after the forms 10 have been set and the rebar 16 has been installed, anchor bolt holders 20 are properly positioned and nailed to the form. Specifically, each anchor bolt holder is placed on the top edge 12 of the form with its flat bottom surface 46 resting on the top edge, and with the sleeve 60 extended inwardly of the form in a cantilever fashion and positioned generally over the rebar. The anchor bolt holder is adjusted lengthwise thereof, depending on the size of the form, so as to position the axis of the sleeve in the exact center of the foundation wall, not shown, to be poured within the forms. It will be understood that the staggered nail holes 88 in the webs 80 allows the holder to be secured in various positions lengthwise of the holder so as to achieve the desired centering.

When the anchor bolt holder 20 is properly positioned (FIG. 1), double headed nails 100 are driven through selected nail holes 88 in the webs 80 through 86 and into the form 10 thereby to secure the anchor bolt holder firmly to the form. With wider forms, the rear plate 94 engages the outside surface of the form, and in that case, an additional nail, not shown, may be driven into the form through the nail slot 96 further to secure the anchor bolt holder to the form.

Thereafter, the shanks 24 of anchor bolts 22 (FIG. 1) are slid upwardly through the sleeves 60 of the various anchor bolt holders 20 with the lower ends 30 under and hooked around the rebar 16. Nuts 28 are then threaded on the exposed upper ends 26 of the anchor bolts thereby to support the anchor bolts in the anchor bolt holders, again, in a cantilever fashion. It will thus be understood that the anchor bolts are positioned exactly where they are intended to be, usually exactly equidistantly between the inside surfaces 14 of the forms and at predetermined distances apart, center to center, usually a maximum of six inches.

Following positioning of the anchor bolts 22 (FIG. 1), concrete is poured around the anchor bolts and the rebar 16 within the form 10 in order to create a foundation wall, not shown, or other structure, but well known in the art. In so doing, concrete often partially covers the anchor bolt holders 20. Also, the heavy concrete moving against the anchor bolts imposes forces on the holders and particularly their sleeves 60 and base plates 34. The sleeve and base plate are able to withstand these forces and maintain the anchor bolts in position, however, because of the reinforcements imparted thereto by the ribs 70, 72, 74 and the webs 80, 82, 84 and 86. After the concrete has set, the anchor bolt holders are removed along with the forms 10. Since the anchor bolt holders are of bright colors, it is relatively easy to see them in order that they can be readily seen and retrieved.

During such removal (FIG. 1), it is significant that the construction of the subject anchor bolt holder 20 is such that it is durable and withstands breakage. In other words, the anchor bolt holders are usually removed first by removing the nuts from the bolts by hand or with a wrench. Then, the claw of a hammer is used to pry the nails out of the form 10 and the anchor bolt holder. Alternatively, the anchor bolt holder itself may be pried away from the form with the claw of the hammer.

All these actions impose considerable stress on the anchor bolt holders 20 (FIG. 1) whereby they require the strength and durability of the subject holder to preserve their integrity. Also, it is to be recognized that the sleeve of each holder shields the upper threaded end 26 of the anchor bolt 22 from concrete or other damage so that the threads will subsequently readily receive the nuts 28 when the anchor bolts are used to attach the wooden sill, not shown, to the foundation. Of course, the fundamental advantage of the subject holder is to maintain the anchor bolts in as nearly vertical position as possible so they will fit up through holes in the sills and receive the nuts thereby to anchor the building to the foundation.

SECOND EMBODIMENT

Figure 6:
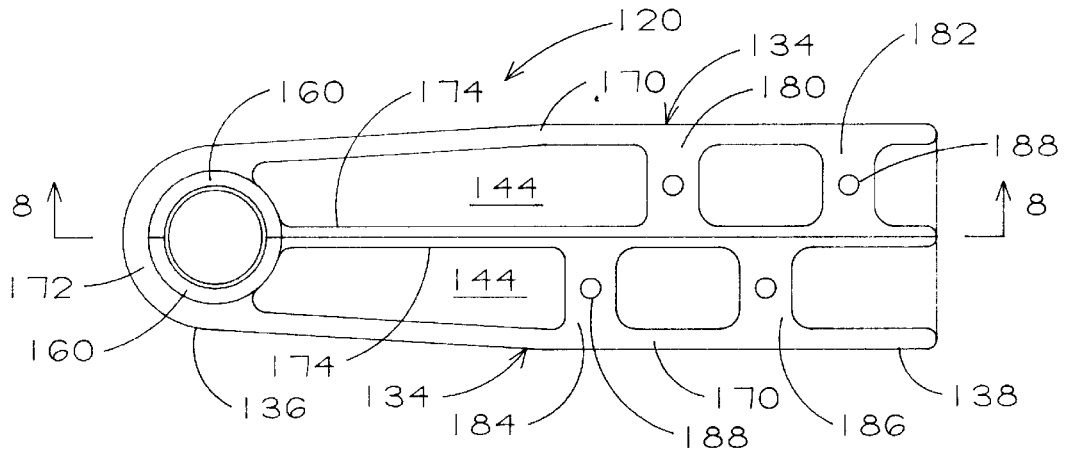
FIG. 6 is a top plan view similar to FIG. 2 but showing another embodiment of the anchor bolt holder in a closed or clamping position.
Figure 7:
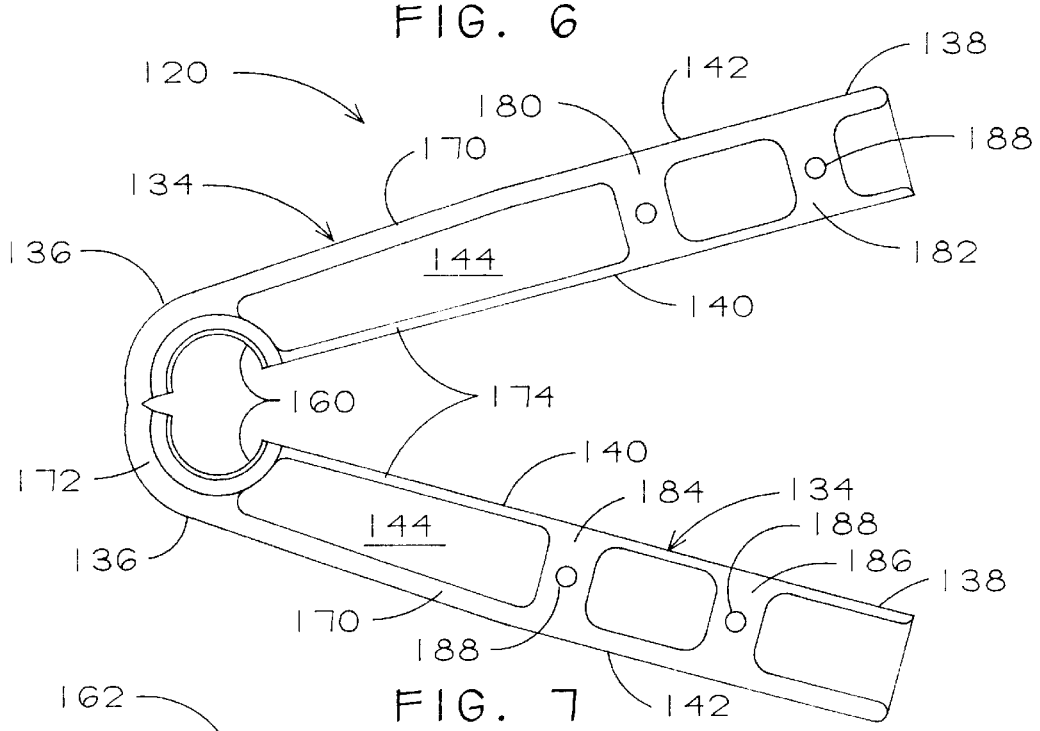
FIG. 7 is a view similar to FIG. 6 but showing the anchor bolt holder in a partially open position.
Figure 8:
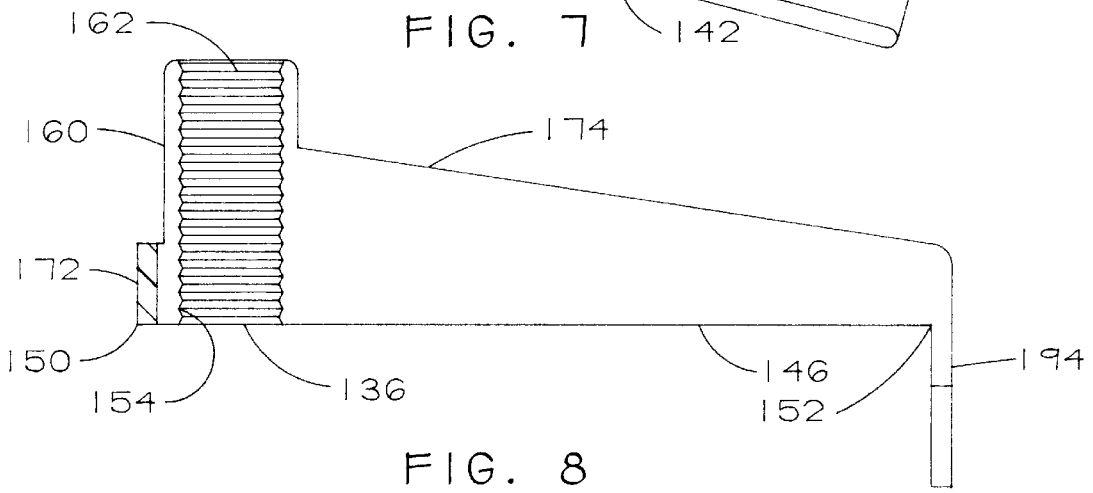
FIG. 8 is a section taken on line 8—8 in FIG. 6.

A second embodiment of the subject invention is a clamping holder identified by the numeral 120 in FIGS. 6, 7, and 8 and is also molded in one piece out of a suitable plastic, such as high impact styrene plastic. The clamping holder is similar to the anchor bolt holder 20 in that it includes a pair of base plates 134 having front and rear ends 136 and 138, inside and outside edges 140 and 142, a top surface 144, and a flat bottom surface 146. The front end of each base plate has an arcuate edge 150 and the rear end has a straight edge 152. Also, the front end of each base plate has a semi-circular opening 154.

Symmetrical sleeve halves 160 (FIGS. 6, 7 and 8) are integral with the front end 136 of each base plate 134 and extend upwardly from the top surface 144 in alignment with the respective semicircular openings 154. The sleeve halves have internal gripping teeth 162 and form a complete sleeve when fitted together, as shown in FIG. 6, wherein the teeth are in continuous rings lengthwise of the sleeve, similar to threads. Elongated side ribs or flanges 170 are integral with each base plate and project upwardly from the top surface of the base plate along the outside edges 142 thereof. Elongated center ribs or flanges 174 are also integral with the base plate and are in upstanding relation from the top surface along the inside edges 140 in parallel relationship to the side ribs.

Webs 180, 182 and 184, 186 (FIGS. 6, 7 and 8) are integral with and interconnect the side and center ribs 170, 174 of each base plate 134 and extend transversely of the base plates. Each web has a nail hole 188 in alignment with the nail holes 156 in the base plates. Still further, rear plates 194 are integral with the rear edges 152 of each base plate 134 and project downwardly therefrom in perpendicular relation to the bottom surfaces 146.

The clamping holder 120 (FIGS. 6, 7 and 8) also includes an arcuate end rib or flange 172 which is integral with the base plate 134 and extends upwardly from the arcuate end edges 150 in partially surrounding relation to the sleeve halves 160. This end rib connects the two halves or parts of the clamping holder but is flexible and serves as a hinge for the holder, allowing the sleeve halves to be moved between a closed position, as shown in FIG. 6, and a fully open position, not shown, although FIG. 7 shows a partially open position.

As with the first embodiment, the side ribs 170, the end ribs 172, and the webs 180, 182 and 184, 186 (FIGS. 6, 7 and 8) are all of the same height, but the center ribs taper upwardly from the rear edge 152 to the sleeve, as shown in FIG. 8. In other words, because of the separation of the base plate and sleeve into two halves, additional reinforcement of the sleeve halves is required to achieve the need durability, and the extension of the center rib along the sleeve halves provides this added strength. As before, more ribs and associated nail holes may be added between the sleeve and the forwardmost webs 180 and 184, to provide greater adjustability.

In use, the clamping holder 120 is particularly suited for holding anchor bolts 22 by simply clamping the holder around the bolt instead of having to slip the holder over the bolt or, conversely, having to slide the bolt into the holder. Also, the clamping holder is useful where the construction element to be held is a long piece of rebar or an in-concrete plumbing pipe. As such, the two base plates 134 are spread apart from each other, and the sleeve halves 160 are placed about the anchor bolt, or other construction element.

Note in FIG. 7 that, for illustrative convenience with the limited space on the drawing sheet, the sleeve halves 160 and base plates 134 are spread only partially apart. In actual use, the sleeve halves are spread far enough apart to permit entry of the shank 24 of an anchor bolt 22 within the sleeve halves. This spreading is permitted because of the flexible hinge 172. After the clamping holder has been placed around the anchor bolt, the base plates are moved toward each other until the center ribs 174 contact whereby the sleeve halves form a continuous sleeve about and in clamping relation to the anchor bolt therewithin.

As will be understood, therefore, the internal diameter of the completely formed sleeve 160/160 is slightly smaller than the outside diameter of a shank, as 24, of an anchor bolt, as 22, or other construction elements being held. A significant advantage of the clamping holder 120 is that it obviates the need for a nut, as 28, on the shank, as 24, 26, of an anchor bolt. Since the clamping holder firmly grasps the anchor bolt, a nut on the bolt is not necessary. Accordingly, the time and labor required to apply and remove nuts on the anchor bolts is saved. Moreover, clamping of the anchor bolts is a better way to insure that the bolts are properly positioned and are restrained from movement laterally or vertically, while protecting the threads of the bolts from being fouled by concrete or other debris.

Thereupon, nails 100 are driven through the nail holes 188 into the forms 10, as before. As such, the anchor bolt 20 is securely positioned and held by the clamping holder 120. After the concrete has been poured and set, the nails are removed from the form and the clamping holder, the base plates 134 are separated and the holder is conveniently removed from the anchor bolt. Again, because of its reinforced construction as described, the clamping holder is durable and withstands pouring of the concrete while holding the anchor bolt in proper position and the rough treatment often given to the holder while it is being removed from the foundation wall for reuse. The anchor bolts are then ready to be fitted into holes in the sills, not shown, of the flaming for the building and fastened thereto by nuts that easily thread on the threaded ends, as 26, of the bolts.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A holder usable in building construction for holding anchor bolts, rebar, and the like elements, in predetermined positions during the pouring of concrete therearound, comprising:

an elongated base plate having front and rear ends, opposite side edges, a top surface and a bottom surface, the front end of the base plate having an end hole therethrough;

a sleeve upstanding from the top surface of the base plate over the end hole for receiving such an element; and elongated side ribs upstanding from the top surface of the base plate, extending lengthwise along and flush with the side edges, and connected to the sleeve.

2. The holder of claim 1, wherein there is an end rib upstanding from the top surface of the base plate, partially surrounding the sleeve and connected to the side ribs.

3. The holder of claim 1, wherein the side ribs are spaced transversely of the base plate, and wherein there are webs upstanding from the top surface of the base plate and interconnecting the side ribs.

4. The holder of claim 1, wherein the sleeve and base plate are divided into halves, and wherein there are means interconnecting the sleeve halves for flexibly moving the sleeve halves and base plate halves between a closed position wherein the sleeve halves form the sleeve for receiving and clamping such an element therein and an open position with the sleeve halves separated for allowing the sleeve halves to be moved around such an element and away from such an element.

5. The holder of claim 4, wherein the side ribs extend along the side edges of the base plate;

wherein there is an end rib upstanding from the top surface of the base plate, extending partially around and connected to the sleeve, and connected to the side ribs on each side of the sleeve; and wherein the base plate, the ribs, and the sleeve are all molded in one piece.

6. The holder of claim 1, wherein there are elongated first and second side ribs;

wherein there are webs upstanding from the base plate, individually connected to the side ribs, extending transversely of the base plate between the ribs, and having nail holes therethrough; and wherein there are means interconnecting the webs.

7. The holder of claim 6, wherein there is an end rib upstanding from the top surface of the base plate, extending partially around and connected to the sleeve, and connected to the side ribs on each side of the sleeve.

8. The holder of claim 6, wherein said means is an elongated center rib upstanding from the top surface of the base plate between the side ribs.

9. The holder of claim 8, wherein said center rib is connected to the sleeve.

10. The holder of claim 8, wherein there are a plurality of webs interconnecting the first rib and the center rib, and wherein there are a plurality of webs interconnecting the second and the center rib, and wherein the webs interconnecting the first and center ribs are offset lengthwise of the base plate from the webs interconnecting the second and center ribs.

11. The holder of claim 8, wherein there is first web interconnecting the first rib and center rib, and wherein there is second web interconnecting the second rib and the center rib.

12. The holder of claim 11, wherein the first and second webs are offset from each other lengthwise of the base plate.

13. A reusable anchor bolt holder molded in one piece, comprising:

an elongated base plate having front and rear ends, opposite side edges, and top and bottom surfaces, said front end having an end edge and said rear end having and end edge, said bottom surface being flat, and the front end of the base plate having a circular end hole therethrough;

a tubular sleeve integral with and upstanding from the top surface of the base plate in perpendicular relation to and at the front end thereof and in concentric relation with the end hole;

elongated first and second side ribs integral with and upstanding from the top surface of the base plate along the side edges thereof so that each rib is flush with its respective side edge;

a central rib integral with and upstanding from the top surface of the base plate equidistant from and between the side ribs, integral with the sleeve, and extending lengthwise of the base plate from the sleeve to said rear end edge;

a plurality of webs integral with and extending between each side rib and the central rib with the webs on each side of the base plate being spaced from each other lengthwise of the base plate each web having a nail hole therethrough parallel to the sleeve, said base plate having nail holes aligned with the nail holes in the webs; and a rear plate integral with the base plate and projecting downwardly from the rear end edge in perpendicular relation to the base plate, the rear plate having a nail slot therein.

14. The holder of claim 13, wherein said side ribs extend lengthwise of the base plate in convergent relation from the rear end edge to the sleeve.

15. The holder of claim 13, wherein the material of the holder is plastic.

16. The holder of claim 13, wherein the holder has brightly colored means thereon so as to enable the holder to be seen when partially covered with concrete.

17. The holder of claim 13:

wherein there is an end rib integral with and upstanding from the top surface of the base plate along the end edge of the front end so that the end rib extends partially around and is integral with the sleeve at the base thereof.

18. The holder of claim 13:

wherein the front end edge is arcuate; and wherein there is an end rib integral with and upstanding from the top surface of the base plate along the arcuate end edge so that the end rib is flush with said arcuate end edge so that end rib partially surrounds and is integral with the sleeve at the base thereof and integrally joins the sleeve and the side ribs on opposite sides of the sleeve.

19. A reusable holder usable in building construction for holding anchor bolts, rebar, and the like, in predetermined positions during the pouring of concrete therearound, comprising:

an elongated base plate having front and rear ends, opposite side edges, a top surface and a flat bottom surface, the front end of the base plate having an end hole therethrough;

a sleeve upstanding from the top surface of the base plate over the end hole;

elongated first and second side ribs upstanding from the top surface of the base plate along the side edges thereof and connected to the sleeve;

webs upstanding from the base plate, individually connected to the side ribs, extending transversely of the base plate between the ribs, and having nail holes therethrough parallel to the sleeve;

means interconnecting the webs; and a rear plate projecting downwardly from the rear end of the base plate, all of the plates, the ribs, the webs, and the sleeve being molded from a plastic having a bright color to enable the holder to be seen when partially covered by cement.

20. A holder usable in building construction for holding anchor bolts, rebar, and like construction elements, in predetermined positions during the pouring of concrete therearound, comprising:

a pair of elongated base plates having front and rear ends, inside and outside edges, a top surface and a flat bottom surface, the front end of each base plate having a semi-circular opening on the inside edge thereof;

a semi-circular sleeve half upstanding from the top surface of each base plate in alignment with its respective opening;

elongated first and second side ribs upstanding from the top surface of each base plate along the outside edges thereof;

elongated center ribs upstanding from the top surface of each base plate along the inside edges thereof;

a web upstanding from each base plate, individually interconnecting its respective outside and center ribs, and having a nail hole therethrough;

a rear plate projecting downwardly from the rear end of each base plate; and hinge means interconnecting the front ends of the base plates for pivotal movement between a closed position wherein the base plates form one large base plate, the center ribs are in face-to-face contact, the sleeve halves mate and form a sleeve, and the rear plates form one large rear plate, and an open position wherein the center ribs and the sleeve halves are spaced apart to allow the sleeve halves to be positioned around a construction element such as an anchor bolt, rebar, or the like, whereupon the base plates can be moved into said closed position in order to clamp the sleeve halves in gripping relation around such construction element.

21. The holder of claim 20, wherein the hinge means is a flexible end rib upstanding from each base plate, extending partially around its sleeve half, and connected to the side ribs on the outside edges of the base plates.

22. The holder of claim 20, wherein the sleeve halves have internal gripping teeth adapted to engage such construction element and preclude movement of the element relative to the holder.

* * * * *